US007926813B2

(12) United States Patent
Moody

(10) Patent No.: US 7,926,813 B2
(45) Date of Patent: Apr. 19, 2011

(54) POKER GAME

(75) Inventor: Ernest W. Moody, Las Vegas, NV (US)

(73) Assignee: Ernest Moody Revocable Trust, Las Vegas, NV (US)

( * ) Notice: Subject to any disclaimer, the term of this patent is extended or adjusted under 35 U.S.C. 154(b) by 955 days.

(21) Appl. No.: 11/368,091

(22) Filed: Mar. 2, 2006

(65) Prior Publication Data

US 2006/0163816 A1 Jul. 27, 2006

Related U.S. Application Data

(62) Division of application No. 10/429,569, filed on May 3, 2003.

(60) Provisional application No. 60/319,639, filed on Oct. 21, 2002.

(51) Int. Cl.
*A63F 1/00* (2006.01)

(52) U.S. Cl. ..... 273/306; 273/292; 273/303

(58) Field of Classification Search ..... 273/306, 273/292, 303–305, 307
See application file for complete search history.

(56) References Cited

U.S. PATENT DOCUMENTS 957,105 A * 5/1910 Crompton ..... 273/306
D91,004 S * 11/1933 Russell ..... D21/379
5,415,414 A * 5/1995 Savage ..... 273/306

* cited by examiner

*Primary Examiner* — Benjamin H Layno
(74) *Attorney, Agent, or Firm* — John Edward Roethel

(57) ABSTRACT

A conventional deck of fifty-two playing cards is modified by the addition of at least one extra card which can be of any of the conventional card ranks, which can be of a fifth suit or a duplicate of one of the conventional cards and which is preferably an Ace. This is additional card can also be of any rank of the conventional cards, but can having a suit designation of all of the suits, and is preferably an Ace of all of the suits. This modified deck of playing cards is used to play video poker.

6 Claims, 3 Drawing Sheets

POKER GAME

CROSS-REFERENCE TO RELATED APPLICATION

This application is a divisional of application Ser. No. 10/429,569, filed May 3, 2003, entitled "Poker Game", now pending and is also based on and claims the benefit of Provisional Application Ser. No. 60/319,639, filed Oct. 21, 2002, entitled "Poker Game", now pending.

This invention relates primarily to a poker game, and more particularly to a poker game that can be played as a live table game or as a video poker game. One or more additional cards are added to a standard fifty-two card deck of playing cards.

BACKGROUND OF THE INVENTION

Poker is a well known game that traditionally uses a fifty-two card deck of standard playing cards. This deck has four suits—Spades, Hearts, Diamonds and Clubs and each suit has thirteen cards of the ranks Deuce up to Ace.

Poker uses poker hand rankings to determine the value of the poker hand. In five card poker, the traditional poker hand rankings are Royal Flush, a Straight Flush, a Four of a Kind, a Full House, a Flush, a Straight, a Three of a Kind, a Two Pair, one Pair and High Card in the hand.

Poker started as a multiple player game in which a player attempted to achieve a poker hand having a higher ranking than the poker hand of the other players. With the advent of casino gaming, poker has also become a single player game, most often player on an electronic video poker machine which has become a well know gaming device and is found in most gaming establishments.

Video poker that is played on an electronic video poker gaming machine is designed to replicate the play of a hand of poker. Typically, the player is not playing against any other player's hands or against a dealer's hand; the player is simply attempting to achieve the highest ranking poker hand possible from the cards displayed to the player. The higher the ranking of the poker hand achieved by the player, the greater the player's winnings based on the number of coins, tokens or credits wagered by the player. Typically, a payout schedule is posted on the gaming machine to advise the player of the payoffs available for certain winning card combinations.

The forerunner of all electronic video poker gaming machines is the video Draw Poker machine that deals cards from a standard fifty-two card poker deck and displays a single five card hand to the player. The player then selects which of the five cards he wishes to hold (or discard depending on the format of the gaming machine). The draw poker machine then displays replacement cards for the cards the player has discarded. The player wins or loses based on conventional poker hand rankings for the resulting five card hand. In video Draw Poker, the conventional poker hand rankings that are winning combinations are a Royal Flush, a Straight Flush, a Four of a Kind, a Full House, a Flush, a Straight, a Three of a Kind, a Two Pair and a Pair of Jacks or Better. Any other poker hand ranking is conventionally a losing hand. A payout table is established which shows the amount to be awarded to the player for winning hands and is based on the number of coins wagered by the player and the type of poker hand achieved.

The classic draw poker machine has been modified to use Jokers as wild cards or to use Deuces (or even other cards) as wild cards. "Jokers Wild" and "Deuces Wild" draw poker still display to the player a single five card hand and allow the player to discard unwanted cards and receive replacement cards. The payout table is modified to recognize the differing odds for achieving various poker hands when wild cards are involved. Furthermore, different poker hand rankings are used in the pay table to recognize different winning combinations that can be achieved using wild cards.

There are many poker formats used in video draw poker. These poker game formats include Jacks (or even Tens) or Better Draw Poker, Bonus Poker, Double Bonus Poker, Double Double Bonus Poker, Super Double Bonus Poker, Triple Bonus Poker, Deuces Wild Poker, Jokers Wild Poker, Deuces and Jokers Wild Poker, etc. Many electronic video poker gaming machines are provided with a menu so that the player can indicate his choice of the poker game format that the player wishes to play and the player then makes his wager based on upon that choice of poker game format. Each poker format has its own pay table associated therewith.

Poker games are played using a "standard" deck or "conventional" deck of fifty-two playing cards. As is well known, a standard or conventional deck of playing cards has four suits Spades, Hearts, Diamonds and Clubs) with each suit having thirteen ranked cards (Deuce, Three, Four, Five, Six, Seven, Eight, Nine, Ten, Jack, Queen, King and Ace).

There have been attempts to add additional cards (besides the addition of one or more Jokers) to the conventional fifty-two card deck and to use such a modified deck in a video poker game. In one version, five extra cards were added to the fifty-two card deck. These cards were an Ace, a King, a Queen, a Jack and a Ten of a fifth suit. The resulting deck had fifty-seven cards. The method of play using this deck was five card draw poker and winning hand combinations included Five-of-a-Kind (of Aces, Kings, Queens, Jacks or Tens) and a Royal Flush of the fifth suit.

One of the drawbacks of this game was that the difficulty of achieving winning hand combinations increases dramatically when five extra cards are added to the conventional fifty-two card deck. The number of possible ending five card hands increases from approximately 2.6 million to approximately 4.2 million.

It is an object of the present invention to provide a new poker game in which at least one extra card is added to the conventional fifty-two card deck to create at least a fifty-three card deck.

It is a feature of the present invention to provide for a method of playing poker in which a modified deck of playing cards is used. A fifty-third card, which can be of any of the conventional card ranks but is of a fifth suit, is added to a standard fifty-two card deck. Preferably this fifty-third card is an Ace.

It is an alternate feature of the present invention to provide for a method of playing poker in which a different modified deck of playing cards is used. A fifty-third card, which can be of any the conventional card ranks and any of the original card suits, is added to a standard fifty-two card deck. Preferably this fifty-third card is an Ace, such as the Ace of Spades.

It is another alternate feature of the present invention to provide for a method of playing poker in which a different modified deck of playing cards is used. A fifty-third card, which can be of any the conventional card ranks and all of the original card suits, is added to a standard fifty-two card deck. Preferably this fifty-third card is an Ace which is considered as having all of the suits as its suit.

It is an advantage of the present invention that, when the additional card is from a fifth suit, additional winning card combinations can be used which gives the player additional chances to achieve winning outcomes. These winning card combinations can include Five-of-a-Kind.

It is an alternative advantage of the present invention that, when the additional card is from a one of the conventional ranks and from one of the original suits, additional winning card combinations can be used which gives the player additional chances to achieve winning outcomes. These winning card combinations can include Five-of-a-Kind. The probability of achieving a conventional winning outcome may also be increased.

It is another alternative advantage of the present invention that, when the additional card is from a one of the conventional ranks and is considered to be all of the original suits, additional winning card combinations can be used which gives the player additional chances to achieve winning outcomes. These winning card combinations can include Five-of-a-Kind. The probability of achieving a conventional winning outcome may also be increased.

Other objects, features and advantages of the present invention will become apparent from a consideration of the following detailed description.

SUMMARY OF THE INVENTION

A conventional deck of fifty-two playing cards is modified by the addition of at least one extra card. This fifty-third card, which can be of any of the conventional card ranks but is of a fifth suit, is added to a standard fifty-two card deck. Preferably this fifty-third card is an Ace.

This additional fifty-third card provides for additional winning outcomes such as Five-of-a-Kind. If the fifty-third card is an Ace of a fifth suit, then the additional winning card combination would be Five Aces.

Alternatively, this fifty-third card, which can be of any the conventional card ranks and any of the original card suits, is added to a standard fifty-two card deck. Preferably this fifty-third card is an Ace, such as the Ace of Spades.

This alternative additional fifty-third card provides for additional winning outcomes such as Five-of-a-Kind. If the fifty-third card is an Ace of Spades, then the additional winning card combination would be Five Aces. The probability of achieving some of the conventional winning card combinations is also increased.

In another alternative embodiment, this fifty-third card, which can be of any the conventional card ranks and is considered to be all of the original card suits, is added to a standard fifty-two card deck. Preferably this fifty-third card is an Ace which is considered to be all of the original card suits.

This alternative additional fifty-third card provides for additional winning outcomes such as Five-of-a-Kind. If the fifty-third card is an Ace of All Suits, then the additional winning card combination would be Five Aces. The probability of achieving some of the conventional winning card combinations is also increased.

DETAILED DESCRIPTION OF THE PREFERRED EMBODIMENTS

Either of the modified decks of playing cards and the methods of the present invention can be applied to any poker format used for video poker. A conventional electronic video poker machine is used to display the method of play of the present invention.

Version #1

The conventional deck of fifty-two playing cards that is typically used in conventional video poker is modified by the addition of at least one extra card. This fifty-third card, which can be of any of the conventional card ranks but is of a fifth suit, is added to the standard fifty-two card deck.

Figure 1:
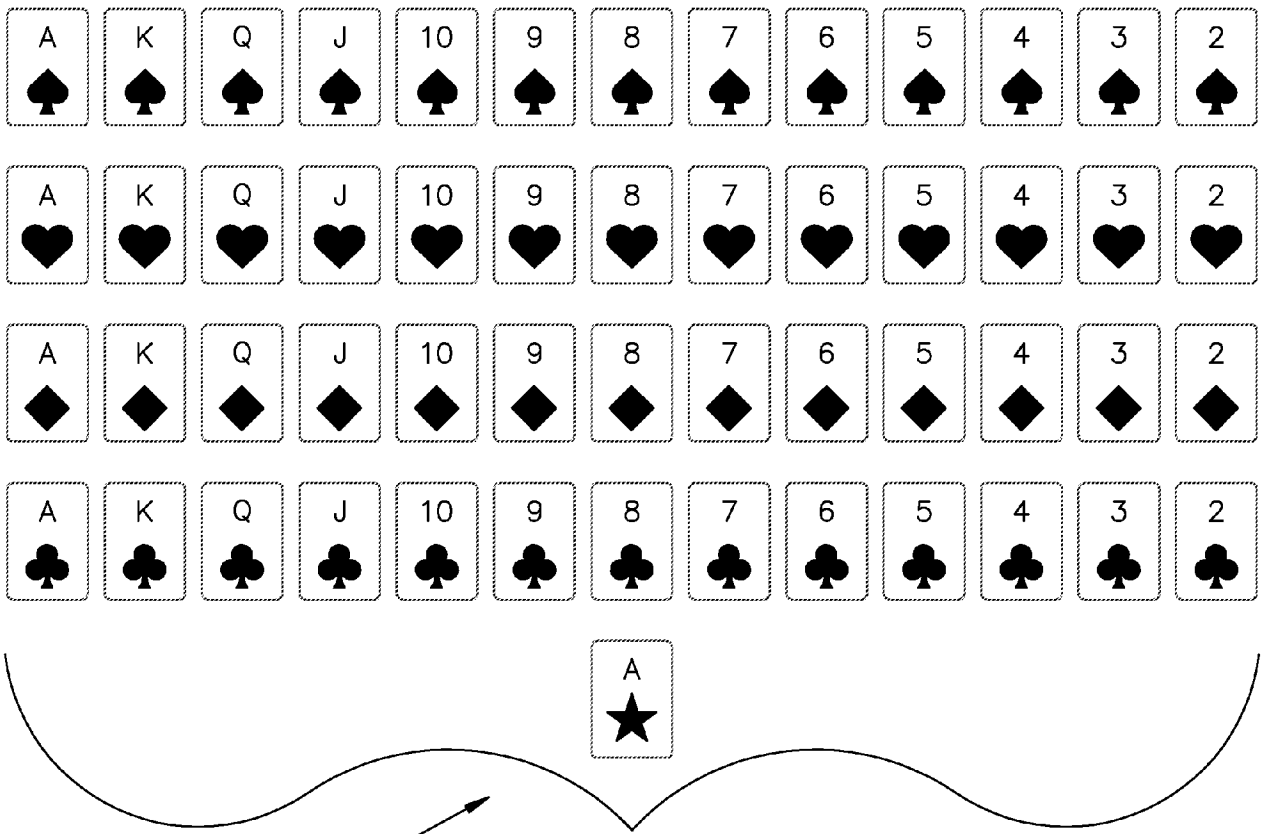
FIG. 1 shows a deck of playing cards of playing cards of the present invention in which the fifty-third card is a fifth-suit card.

Any of the conventional card ranks can be used from Deuce through Ace. In the preferred embodiment of the present invention, this fifty-third card is an Ace of any suitable fifth suit, such as the Ace of Stars. A deck of cards for Version 1 is shown in FIG. 1 at 100.

The method of play is conducted in the conventional manner. The modified fifty-three card deck is electronically shuffled and five cards are displayed to the player. The player selects which of the cards the player wishes to hold and the remaining cards are discarded. Replacement cards are displayed to the player to create the final five card hand. The poker hand ranking of the final five card hand is determined. If the player has achieved a winning poker hand ranking for the final five card hand, the player receives an award. The amount of the award is based on a pay table which has been displayed to the player. The pay table is determined mathematically based on the probability of achieving the various combinations that are designated as winning poker hand combinations.

The addition of a fifty-third card of a fifth suit increases the number of possible final five card outcomes from approximately 2.6 million to approximately 2.9 million. Thus the pay table must be adjusted to account for the change in the probability of achieving the pre-designated winning poker hand combinations. Any suitable pay table can be used depending on the overall game return which the gaming establishment wishes to offer to the player.

Since the fifty-third card can be of any conventional card rank but of a fifth suit, an additional winning poker hand ranking of Five-of-a-Kind can be used. If the fifty-third card is an Ace, the additional winning poker hand ranking of Five Aces can be used.

Additionally, the fifty-third card can be used as a "kicker" much as Aces, Deuces, Threes and Fours are used as "kickers" in various poker formats such as in the Double Double Bonus Poker format. The effect of a "kicker" is to increase the payouts in a pay table when the player achieves certain Four-of-a-Kinds as a winning hand combination.

For example, if the fifty-third card is an Ace of a fifth suit, such as the Ace of Stars, then the payouts can be increased when the player achieves Four-of-a-Kind with the Ace of Stars as the fifth card kicker. Typically, the payouts would be doubled for achieving a Four-of-a-Kind with this kicker.

Version #2

The conventional deck of fifty-two playing cards that is typically used in conventional video poker is modified by the addition of at least one extra card. This fifty-third card, which can be of any of the conventional card ranks and any of the conventional suits, is added to the standard fifty-two card deck.

Figure 2:
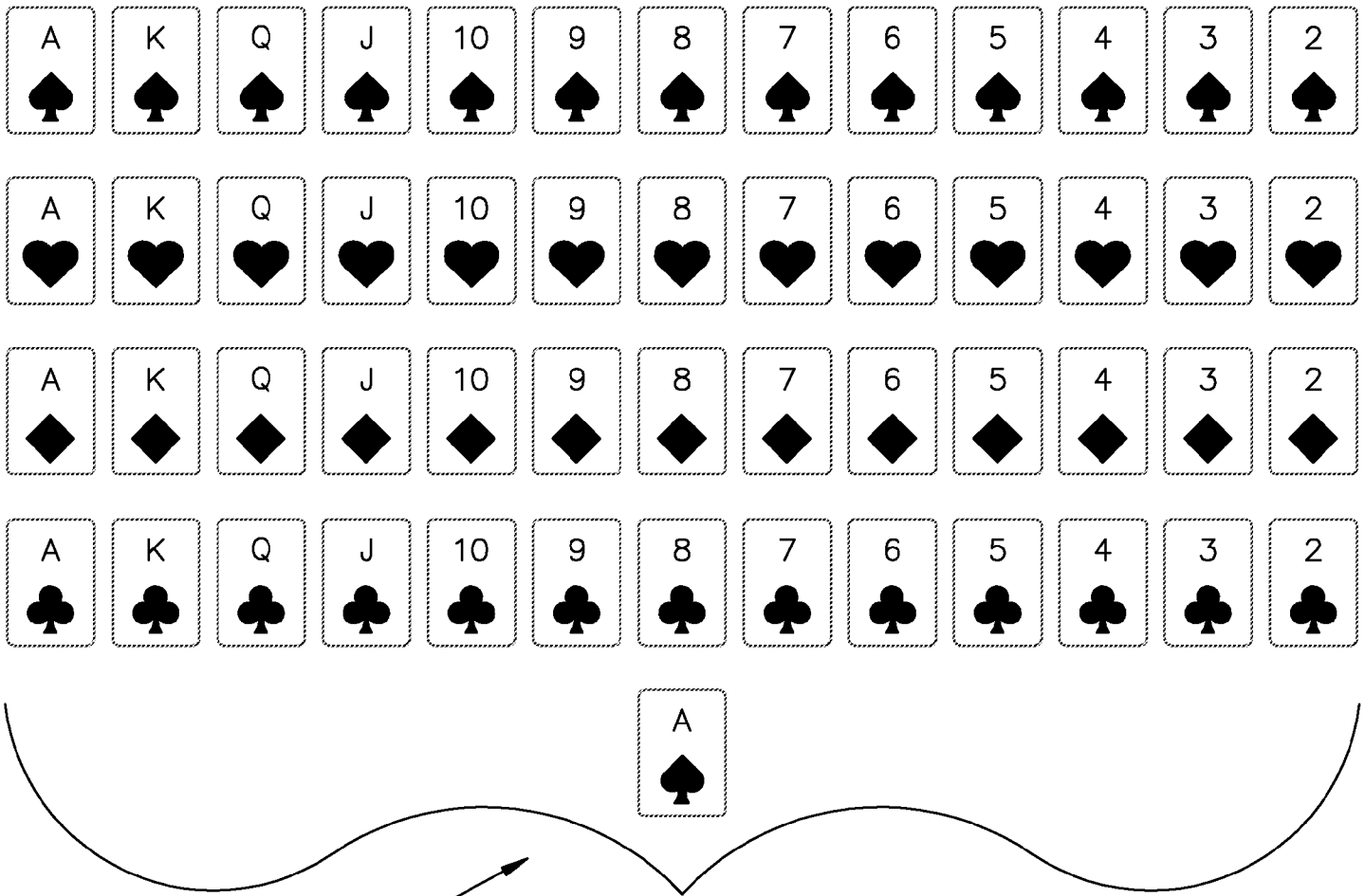
FIG. 2 shows a deck of playing cards of playing cards of the present invention in which the fifty-third card is a duplicate card.

Any of the conventional card ranks can be used from Deuce through Ace. In the preferred embodiment of the present invention, this fifty-third card is an Ace of any of the conventional suits, such as the Ace of Spades. A deck of cards for Version 2 is shown in FIG. 2 at 200.

The method of play is conducted in the conventional manner. The modified fifty-three card deck is electronically shuffled and five cards are displayed to the player. The player selects which of the cards the player wishes to hold and the remaining cards are discarded. Replacement cards are displayed to the player to create the final five card hand. The poker hand ranking of the final five card hand is determined. If the player has achieved a winning poker hand ranking for the final five card hand, the player receives an award. The amount of the award is based on a pay table which has been displayed to the player. The pay table is determined mathematically based on the probability of achieving the various combinations that are designated as winning poker hand combinations.

The addition of a fifty-third card of any conventional card rank and any conventional card suit increases the number of possible final five card outcomes from approximately 2.6 million to approximately 2.9 million. Thus the pay table must be adjusted to account for the change in the probability of achieving the pre-designated winning poker hand combinations. Any suitable pay table can be used depending on the overall game return which the gaming establishment wishes to offer to the player.

Since the fifty-third card can be of any conventional card rank and card suit, an additional winning poker hand ranking of Five-of-a-Kind can be used. If the fifty-third card is an Ace, the an additional winning poker hand ranking of Five Aces can be used.

Additionally, the probability of achieving some of the conventional winning card combinations is also increased. For example, if the fifty-third card added is the Aces of Spades, the fifty-three card deck now has fourteen Spades and Five Aces.

Compared to the conventional fifty-two card deck of playing cards, the probability of achieving a Spade Straight Flush of Ace through Five, a Spade Flush, a Straight that includes an Ace, Four Aces, Three Aces, a Pair of Aces, a Full House which includes Aces, a Pair of Aces with another Pair and even a Spade Royal Flush have all been increased. Likewise, the probability of achieving all of the other conventional winning poker hand combinations has been decreased.

Version #3

The conventional deck of fifty-two playing cards that is typically used in conventional video poker is modified by the addition of at least one extra card. This fifty-third card, which can be of any of the conventional card ranks and is considered to be all of the conventional suits, is added to the standard fifty-two card deck. The additional card could be called an All Suits card.

Figure 3:
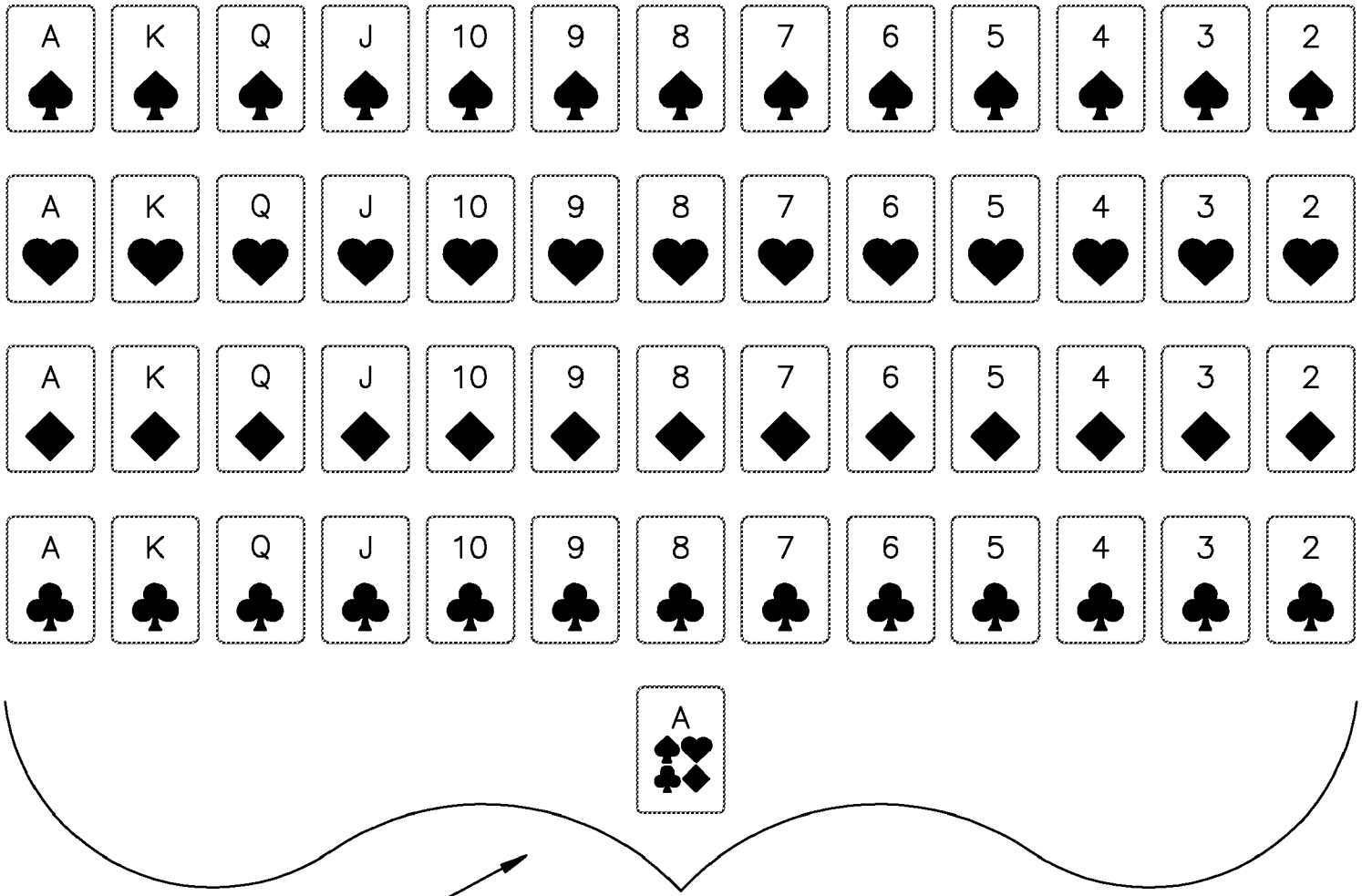
FIG. 3 shows a deck of playing cards of playing cards of the present invention in which the fifty-third card is an all suit card.

Any of the conventional card ranks can be used from Deuce through Ace. In the preferred embodiment of the present invention, this fifty-third card is an Ace of all of the conventional suits, such as the Ace of All Suits. A deck of cards for Version 3 is shown in FIG. 3 at 300.

The method of play is conducted in the conventional manner. The modified fifty-three card deck is electronically shuffled and five cards are displayed to the player. The player selects which of the cards the player wishes to hold and the remaining cards are discarded. Replacement cards are displayed to the player to create the final five card hand. The poker hand ranking of the final five card hand is determined. If the player has achieved a winning poker hand ranking for the final five card hand, the player receives an award. The amount of the award is based on a pay table which has been displayed to the player. The pay table is determined mathematically based on the probability of achieving the various combinations that are designated as winning poker hand combinations.

The addition of a fifty-third card of any conventional card rank and any conventional card suit increases the number of possible final five card outcomes from approximately 2.6 million to approximately 2.9 million. Thus the pay table must be adjusted to account for the change in the probability of achieving the pre-designated winning poker hand combinations. Any suitable pay table can be used depending on the overall game return which the gaming establishment wishes to offer to the player.

Since the fifty-third card can be of any conventional card rank and is considered to be of all of the conventional card suits, an additional winning poker hand ranking of Five-of-a-Kind can be used. If the fifty-third card is an Ace, the an additional winning poker hand ranking of Five Aces can be used.

Additionally, the probability of achieving some of the conventional winning card combinations is also increased. For example, if the fifty-third card added is the Aces of All Suits, the fifty-three card deck now has thirteen Spades, thirteen Hearts, thirteen Diamonds and thirteen Clubs and one card of All Suits. The fifty-three card deck also has Five Aces.

Compared to the conventional fifty-two card deck of playing cards, the probability of achieving a Straight Flush of Ace through Five, a Flush in any suit, a Straight that includes an Ace, Four Aces, Three Aces, a Pair of Aces, a Full House which includes Aces, a Pair of Aces with another Pair and even a Royal Flush of any suit have all been increased. Likewise, the probability of achieving all of the other conventional winning poker hand combinations has been decreased.

If the player has made a wager to participate in the method of play of any of the versions of the present invention and the player has achieved a winning poker hand combination, the award to the player is based on the pay table and the amount of the player's wager.

Any of the modified decks of playing cards and the methods of the present can also be employed as a live table game in which a dealer deals cards to one or more players seated around a gaming table. The game is carried out substantially the same as if being played on an electronic video poker machine.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A deck of playing cards consisting essentially of a standard deck of fifty-two cards and a fifty-third card consisting of a duplicate of one of the cards of the standard deck of fifty-two cards.

2. The deck of claim 1 in which the fifty-third card is an Ace.

3. A deck of playing cards consisting essentially of a standard deck of fifty-two cards and a fifty-third card consisting of a card of a fifth suit and of a rank selected from the group consisting essentially of Deuce, Three, Four, Five, Six, Seven, Eight, Nine, Ten, Jack, Queen, King and Ace.

4. A deck of playing cards consisting essentially of a standard deck of fifty-two cards and a fifty-third card consisting of an Ace of a fifth suit.

5. A deck of playing cards consisting essentially of a standard deck of fifty-two cards and a fifty-third card consisting of a card having a rank selected from the group consisting essentially of Deuce, Three, Four, Five, Six, Seven, Eight, Nine, Ten, Jack, Queen, King and Ace and having a suit of all of the conventional suits.

6. The deck of claim 5 in which the fifty-third card is an Ace.

* * * * *